US011087690B2

(12) United States Patent
Lu et al.

(10) Patent No.: US 11,087,690 B2
(45) Date of Patent: Aug. 10, 2021

(54) DISPLAY SUBSTRATE, DISPLAY DEVICE, CONTROL METHOD AND CONTROL CIRCUIT

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Xu Lu, Beijing (CN); Hengzhen Liang, Beijing (CN); Xiaolong Zhu, Beijing (CN); Lianbin Liu, Beijing (CN); Fan Li, Beijing (CN); Shihao Wang, Beijing (CN); Huan Meng, Beijing (CN); Wen Xu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/641,082

(22) PCT Filed: Mar. 19, 2019

(86) PCT No.: PCT/CN2019/078594
§ 371 (c)(1),
(2) Date: Feb. 21, 2020

(87) PCT Pub. No.: WO2020/186433
PCT Pub. Date: Sep. 24, 2020

(65) Prior Publication Data

US 2020/0302865 A1 Sep. 24, 2020

(51) Int. Cl.
*G09G 3/3258* (2016.01)
*G09G 3/20* (2006.01)
*G09G 3/36* (2006.01)

(52) U.S. Cl.
CPC ..... *G09G 3/3258* (2013.01); *G09G 3/2003* (2013.01); *G09G 3/3607* (2013.01); (Continued)

(58) Field of Classification Search
CPC ... G09G 2300/0866; G09G 2300/0452; G09G 3/3208; G09G 3/3607; G09G 3/2003; (Continued)

(56) References Cited

U.S. PATENT DOCUMENTS 9,396,516 B2 * 7/2016 Schmidt ..... G01R 13/029
9,466,241 B2 * 10/2016 Jeong ..... G09G 3/3233
(Continued)

*Primary Examiner* — Dismery Mercedes
(74) *Attorney, Agent, or Firm* — The Webb Law Firm

(57) ABSTRACT

The present disclosure provides a display substrate, a display device, a control method and a control circuit. The display substrate includes a bending area. The bending area includes a plurality of first sub-pixels and a plurality of other sub-pixels having a light emission color different from a light emission color of the first sub-pixels. The plurality of first sub-pixels are electrically connected to a first power supply voltage terminal for providing a first power supply voltage. The other sub-pixels are electrically connected to other power supply voltage terminals different from the first power supply voltage terminal.

7 Claims, 6 Drawing Sheets

(52) U.S. Cl.
CPC ..... *G09G 2320/0271* (2013.01); *G09G 2320/0276* (2013.01); *G09G 2330/021* (2013.01); *G09G 2380/02* (2013.01)

(58) Field of Classification Search
CPC ..... G09G 2380/02; G09G 2320/0233; G09G 2320/0276; G09G 2320/0271
See application file for complete search history.

(56) References Cited

U.S. PATENT DOCUMENTS

| | | | | |
|---|---|---|---|---|
| 9,830,882 | B2 * | 11/2017 | Yata | G09G 5/02 |
| 10,347,164 | B2 * | 7/2019 | Roh | G09G 3/2074 |
| 10,460,681 | B2 * | 10/2019 | An | G09G 3/006 |
| 10,497,306 | B2 * | 12/2019 | Lee | G09G 3/3233 |
| 2005/0030268 | A1 * | 2/2005 | Zhang | G09G 3/3208 345/83 |
| 2014/0118319 | A1 * | 5/2014 | Jeon | G06F 1/00 345/207 |
| 2014/0313242 | A1 * | 10/2014 | Kaplan | G09G 3/3208 345/694 |
| 2018/0033380 | A1 * | 2/2018 | An | G06T 7/001 |
| 2018/0075797 | A1 * | 3/2018 | Park | G09G 3/3233 |
| 2018/0082632 | A1 * | 3/2018 | Lee | G09G 3/3233 |
| 2020/0066219 | A1 * | 2/2020 | Hsu | G09G 3/006 |

* cited by examiner

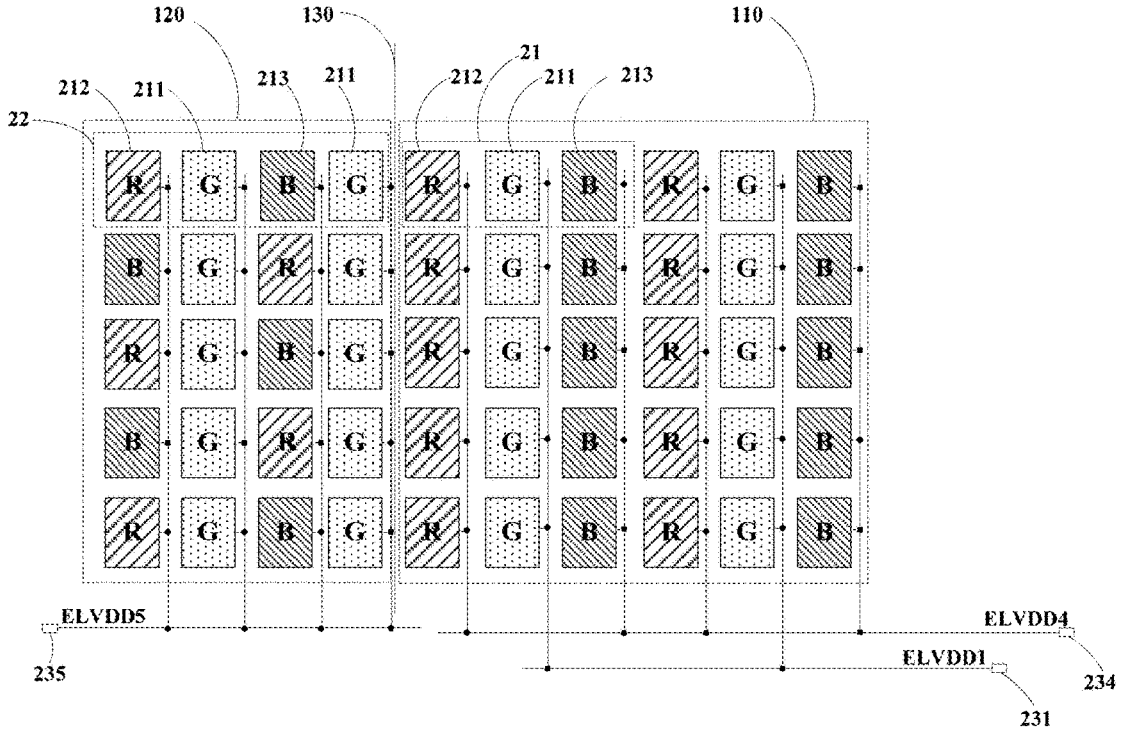

Fig. 3

Obtain display image information of the bending area of the display panel and standard image information corresponding to the display image information, wherein the display image information comprises an abscissa and an ordinate of color coordinates, and the standard image information comprises a predetermined abscissa range and a predetermined ordinate range of the color coordinates — S402

↓

Adjust at least one of the first power supply voltage, the second power supply voltage, or the third power supply voltage according to the abscissa and the ordinate of the color coordinates of the display image information, as well as the predetermined abscissa range and the predetermined ordinate range, so that the abscissa of the color coordinates of the display image information is within the predetermined abscissa range, and the ordinate of the color coordinates of the display image information is within the predetermined ordinate range — S404

Fig. 4

DISPLAY SUBSTRATE, DISPLAY DEVICE, CONTROL METHOD AND CONTROL CIRCUIT

CROSS-REFERENCE TO RELATED APPLICATIONS

The present application is a U.S. National Stage Application under 35 U.S.C. § 371 of International Patent Application No. PCT/CN2019/078594, filed on Mar. 19, 2019, the disclosure of which is incorporated by reference herein in its entirety.

TECHNICAL FIELD

The present disclosure relates to a display substrate, a display device, a control method, and a control circuit.

BACKGROUND

At present, in order to increase the edge display of the display screen (e.g., an OLED (Organic Light-Emitting Diode) display screen) and improve the user's experience, the right-angle CG (Cover Glass) attachment technology may be employed. The display screen prepared by this technology may be applied to products such as mobile phones.

SUMMARY

According to one aspect of embodiments of the present disclosure, a display substrate is provided. The display substrate comprises: a bending area comprising a plurality of first sub-pixels and a plurality of other sub-pixels having a light emission color different from a light emission color of the plurality of first sub-pixels; wherein the plurality of first sub-pixels are electrically connected to a first power supply voltage terminal for providing a first power supply voltage; the plurality of other sub-pixels are electrically connected to other power supply voltage terminals different from the first power supply voltage terminal.

In some embodiments, the plurality of other sub-pixels comprise a plurality of second sub-pixels and a plurality of third sub-pixels, wherein the plurality of first sub-pixels, the plurality of second sub-pixels, and the plurality of third sub-pixels are sub-pixels having different light emission colors.

In some embodiments, the other power supply voltage terminals comprise a second power supply voltage terminal for providing a second power supply voltage and a third power supply voltage terminal for providing a third power supply voltage; and in the bending area, the plurality of second sub-pixels are electrically connected to the second power supply voltage terminal, and the plurality of third sub-pixels are electrically connected to the third power supply voltage terminal.

In some embodiments, the other power supply voltage terminals comprise a fourth power supply voltage terminal for providing a fourth power supply voltage; and in the bending area, the plurality of second sub-pixels and the plurality of third sub-pixels are electrically connected to the fourth power supply voltage terminal.

In some embodiments, in the bending area, sub-pixels in a same sub-pixel column are sub-pixels having a same light emission color.

In some embodiments, in the bending area, sub-pixels respectively in two adjacent sub-pixel columns have different light emission colors.

In some embodiments, the bending area comprises a plurality of first-type pixels, each of which comprises a first sub-pixel, a second sub-pixel, and a third sub-pixel in a same sub-pixel row, wherein in each of the plurality of first-type pixels, the second sub-pixel and the third sub-pixel are adjacent to the first sub-pixel respectively, and the first sub-pixel is between the second sub-pixel and the third sub-pixel.

In some embodiments, the display substrate further comprises: a flat area adjacent to the bending area, wherein the flat area comprises a plurality of second-type pixels, each of which comprises two first sub-pixels, a second sub-pixel and a third sub-pixel in a same sub-pixel row, wherein in each of the plurality of second-type pixels, the second sub-pixel and the third sub-pixel are spaced apart by one of the two first sub-pixels, the two first sub-pixels are spaced apart by the second sub-pixel or the third sub-pixel.

In some embodiments, all first sub-pixels, second sub-pixels, and third sub-pixels in the flat area are electrically connected to a fifth power supply voltage terminal for providing a fifth power supply voltage.

In some embodiments, the first sub-pixel is a green sub-pixel, the second sub-pixel is a red sub-pixel, and the third sub-pixel is a blue sub-pixel.

In some embodiments, the first power supply voltage is lower than power supply voltages provided by the other power supply voltage terminals.

According to another aspect of embodiments of the present disclosure, a display device is provided. The display device comprises the display substrate as described previously.

According to another aspect of embodiments of the present disclosure, a control method for a display panel is provided. The display panel comprises the display substrate as described previously; the control method comprises: providing the first power supply voltage to the plurality of first sub-pixels in the bending area, and providing other power supply voltages to the plurality of other sub-pixels in the bending area which have a light emission color different from a light emission color of the plurality of first sub-pixels.

In some embodiments, the plurality of other sub-pixels comprise a plurality of second sub-pixels and a plurality of third sub-pixels, wherein the plurality of first sub-pixels, the plurality of second sub-pixels and the plurality of third sub-pixels are sub-pixels having different light emission colors; and the providing other power supply voltages comprises: providing a second power supply voltage to the plurality of second sub-pixels in the bending area, and providing a third power supply voltage to the plurality of third sub-pixels in the bending area.

In some embodiments, the plurality of other sub-pixels comprise a plurality of second sub-pixels and a plurality of third sub-pixels, wherein the plurality of first sub-pixels, the plurality of second sub-pixels and the plurality of third sub-pixels are sub-pixels having different light emission colors; and the providing other supply voltages comprises: providing a fourth power supply voltage to the plurality of second sub-pixels and the plurality of third sub-pixels in the bending area.

In some embodiments, the control method further comprises: obtaining display image information of the bending area of the display panel and standard image information corresponding to the display image information, wherein the display image information comprises an abscissa and an ordinate of color coordinates, and the standard image information comprises a predetermined abscissa range and a predetermined ordinate range of the color coordinates; and adjusting at least one of the first power supply voltage, the second power supply voltage, or the third power supply voltage according to the abscissa and the ordinate of the color coordinates of the display image information, as well as the predetermined abscissa range and the predetermined ordinate range, so that the abscissa of the color coordinates of the display image information is within the predetermined abscissa range, and the ordinate of the color coordinates of the display image information is within the predetermined ordinate range.

In some embodiments, each of the plurality of first sub-pixels is a green sub-pixel, each of the plurality of second sub-pixels is a red sub-pixel, and each of the plurality of third sub-pixels is a blue sub-pixel.

In some embodiments, the adjusting of at least one of the first power supply voltage, the second power supply voltage, or the third power supply voltage comprises: adjusting the second power supply voltage according to the abscissa of the color coordinates of the display image information and the predetermined abscissa range, so that the abscissa of the color coordinates of the display image information is within the predetermined abscissa range; and adjusting at least one of the first power supply voltage or the third power supply voltage according to the ordinate of the color coordinates of the display image information and the predetermined ordinate range, so that the ordinate of the color coordinates of the display image information is within the predetermined ordinate range.

In some embodiments, the display image information further comprises display brightness, and the standard image information further comprises a predetermined brightness range; before adjusting the second power supply voltage according to the abscissa of the color coordinates of the display image information and the predetermined abscissa range, the control method further comprises: adjusting at least one of the first power supply voltage, the second power supply voltage, or the third power supply voltage according to the display brightness and the predetermined brightness range so that the display brightness is within the predetermined brightness range.

In some embodiments, the control method further comprises: determining whether an adjusted display brightness is within the predetermined brightness range, whether an adjusted abscissa of the color coordinates is within the predetermined abscissa range, and whether an adjusted ordinate of the color coordinates is within the predetermined ordinate range; wherein at least one of the first power supply voltage, the second power supply voltage, or the third power supply voltage is continuously adjusted so that the display brightness of the display image information is adjusted to be within the predetermined brightness range in a case where the adjusted display brightness is not within the predetermined brightness range; the second power supply voltage is continuously adjusted so that the abscissa of the color coordinates of the display image information is adjusted to be within the predetermined abscissa range in a case where the adjusted abscissa of the color coordinates is not within the predetermined abscissa range; and at least one of the first power supply voltage or the third power supply voltage is continuously adjusted so that the ordinate of the color coordinates of the display image information is adjusted to be within the predetermined ordinate range in a case where the adjusted ordinate of the color coordinates is not within the predetermined ordinate range.

In some embodiments, the adjusting of the second power supply voltage according to the abscissa of the color coordinates of the display image information and the predetermined abscissa range comprises: reducing the second power supply voltage in a case where the abscissa of the color coordinates of the display image information is greater than an upper limit value of the predetermined abscissa range; and increasing the second power supply voltage in a case where the abscissa of the color coordinates of the display image information is less than a lower limit value of the predetermined abscissa range.

In some embodiments, the adjusting of at least one of the first power supply voltage or the third power supply voltage according to the ordinate of the color coordinates of the display image information and the predetermined ordinate range comprises: reducing at least one of the first power supply voltage or the third power supply voltage in a case where the ordinate of the color coordinates of the display image information is greater than an upper limit value of the predetermined ordinate range; and increasing at least one of the first power supply voltage or the third power supply voltage in a case where the ordinate of the color coordinates of the display image information is less than a lower limit value of the predetermined ordinate range.

In some embodiments, the adjusting of at least one of the first power supply voltage, the second power supply voltage or the third power supply voltage according to the display brightness and the predetermined brightness range comprises: reducing the first power supply voltage in a case where the display brightness is greater than an upper limit value of the predetermined brightness range; and increasing at least one of the second power supply voltage or the third power supply voltage in a case where the display brightness is less than a lower limit value of the predetermined brightness range.

In some embodiments, the first power supply voltage is lower than the other power supply voltages.

According to another aspect of embodiments of the present disclosure, a control circuit for a display panel is provided. The display panel comprises the display substrate as described previously; the control circuit comprises: a first voltage supply sub-circuit configured to provide the first power supply voltage to the plurality of first sub-pixels in the bending area; and other voltage supply sub-circuits configured to provide other power supply voltages to the plurality of other sub-pixels in the bending area which have a light emission color different from a light emission color of the plurality of first sub-pixels.

In some embodiments, the plurality of other sub-pixels comprise a plurality of second sub-pixels and a plurality of third sub-pixels, wherein the plurality of first sub-pixels, the plurality of second sub-pixels and the plurality of third sub-pixels are sub-pixels having different light emission colors; and the other voltage supply sub-circuits comprise: a second voltage supply sub-circuit configured to provide a second power supply voltage to the plurality of second sub-pixels in the bending area; and a third voltage supply sub-circuit configured to provide a third power supply voltage to the plurality of third sub-pixels in the bending area.

In some embodiments, the plurality of other sub-pixels comprise a plurality of second sub-pixels and a plurality of third sub-pixels, wherein the first sub-pixels, the second sub-pixels and the third sub-pixels are sub-pixels having different light emission colors; and the other voltage supply sub-circuits comprise: a fourth voltage supply sub-circuit configured to provide a fourth power supply voltage to the plurality of second sub-pixels and the plurality of third sub-pixels in the bending area.

In some embodiments, the control circuit further comprises: an obtaining sub-circuit configured to obtain display image information of the bending area of the display panel and standard image information corresponding to the display image information, wherein the display image information comprises an abscissa and ordinate of color coordinates, and the standard image information comprises a predetermined abscissa range and a predetermined ordinate range of the color coordinates; and an adjusting sub-circuit configured to adjust at least one of the first power supply voltage, the second power supply voltage, or the third power supply voltage according to the abscissa and ordinate of the color coordinates of the display image information, as well as the predetermined abscissa range and the predetermined ordinate range so that the abscissa of the color coordinates of the display image information is within the predetermined abscissa range, and the ordinate of the color coordinates of the display image information is within the predetermined ordinate range.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure may be more clearly understood from the following detailed description with reference to the accompanying drawings, in which:

FIG. 3 is a schematic view showing a sub-pixel arrangement of a display substrate according to another embodiment of the present disclosure;

FIG. 4 is a flowchart showing a control method for a display panel according to an embodiment of the present disclosure;

Figure 1:
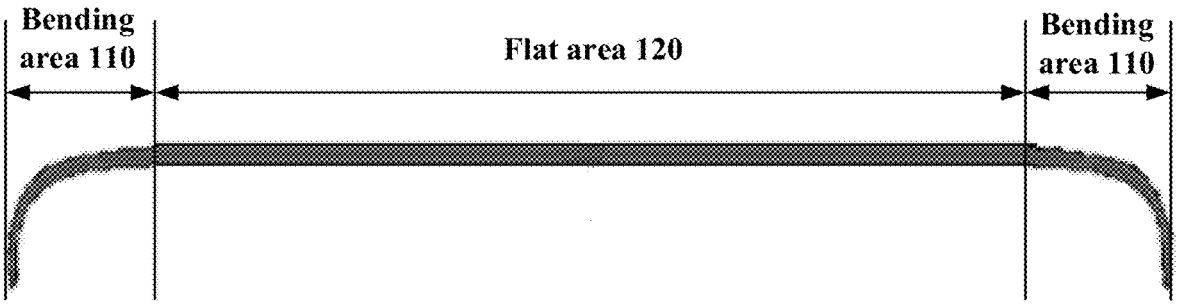
FIG. 1 is a schematic cross-sectional view showing a display panel according to an embodiment of the present disclosure.

It should be understood that the dimensions of the various parts shown in the accompanying drawings are not necessarily drawn according to the actual scale. In addition, the same or similar reference signs are used to denote the same or similar components.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include" or variants thereof means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

All the terms (comprising technical and scientific terms) used in the present disclosure have the same meanings as understood by those skilled in the art of the present disclosure unless otherwise defined. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

FIG. 1 is a schematic cross-sectional view showing a display panel according to an embodiment of the present disclosure. FIG. 1 shows a display panel prepared using a right-angle CG attachment process.

As shown in FIG. 1, the display panel comprises a bending area 110. In some embodiments, as shown in FIG. 1, the display panel further comprises a flat area 120. For example, the bending area 110 may be respectively provided on both sides of the flat area 120. By providing the bending area, the edge display of the display panel may be implemented, thereby increasing the screen-to-body ratio.

In addition, in some embodiments, a system software may be provided in a display device (e.g., a mobile phone) to which the display panel is applied to implement side edge touch, so that the power button and the volume adjustment button provided at sides of the display device may be abolished.

Figure 9:
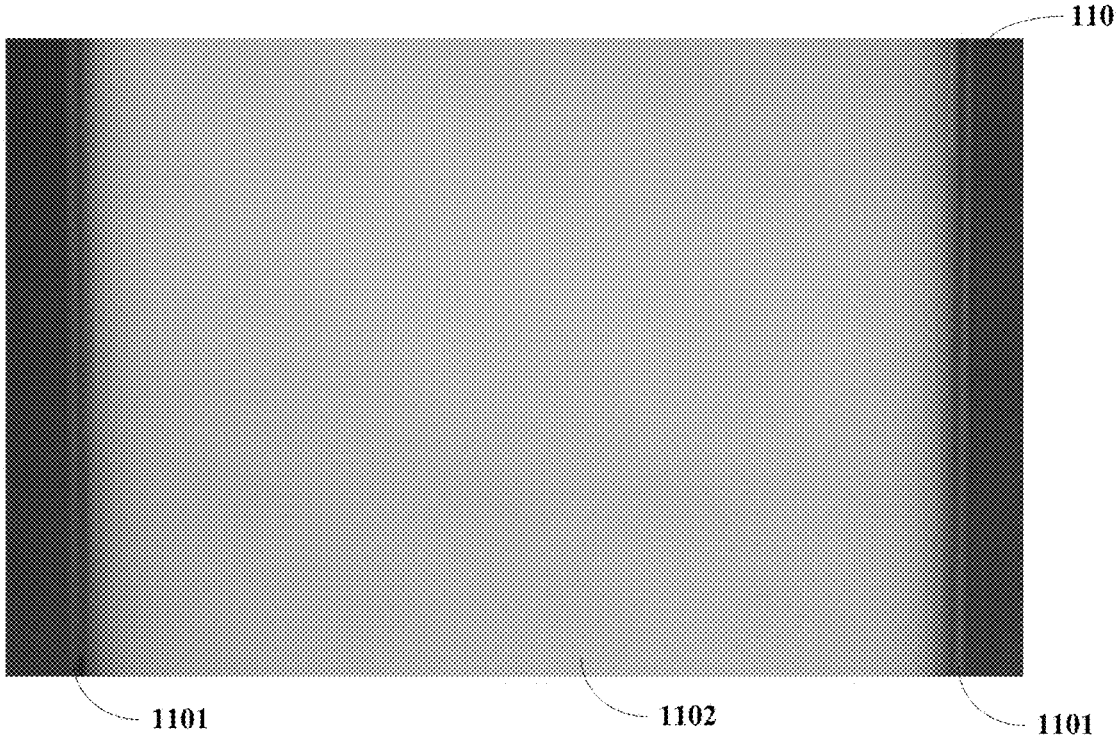
FIG. 9 is a schematic view showing an experimental result of a bright line appearing at an edge of a display panel during display of the display panel.

The inventors of the present disclosure have found that, during display of a flexible OLED display screen, in a right-angle CG attachment state, the display screen may possibly have a problem of a bright line at an edge. For example, the color of the bright line at the edge is yellow, so it may be referred to as a yellow edge phenomenon. For example, as shown in FIG. 9, during the display panel displaying, for example, a pure white picture 1102, a bright line 1101 appears at the bending area 110 of the display panel.

Figure 10:
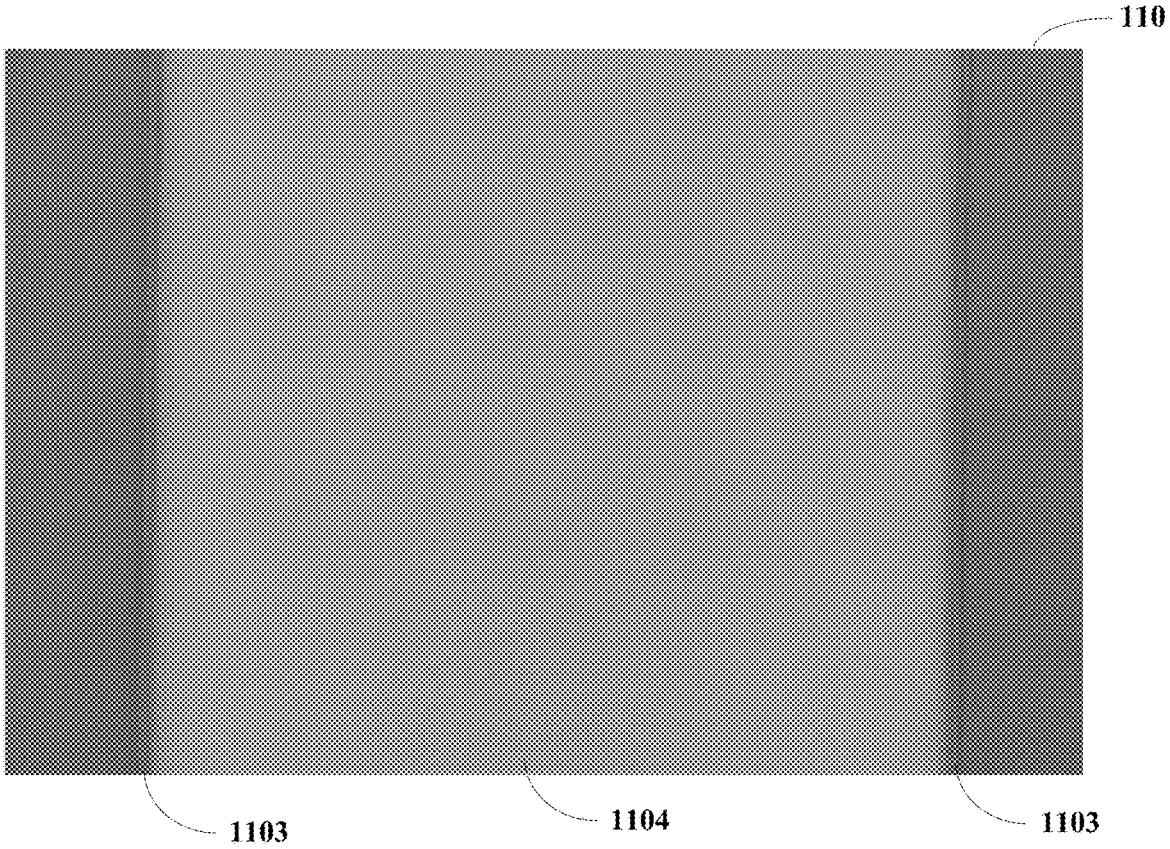
FIG. 10 is a schematic view showing an experimental result of a bright line appearing at an edge of a display panel during display of a green picture of the display panel.

After research, the inventors of the present disclosure have found that, in the case of comparing three colors pictures of pure red, pure green, and pure blue, the pure green picture is prone to have a bright edge problem. For example, as shown in FIG. 10, when the display panel displays the green picture 1104, a bright line 1103 appears at the bending area 110. In addition, the inventors of the present disclosure have also found that, in the case where the brightness of the pure green picture is reduced, it is possible to reduce a yellow edge phenomenon. Therefore, the yellowing of the edges of the display may be caused by the dispersion of light from the green pixels at the right-angle edges of the CG.

In view of the above, the inventors of the present disclosure provide a sub-pixel arrangement for a display substrate of a display panel, so as to alleviate the above-described problem that there is a bright line at an edge. The sub-pixel arrangement at the edge of the display substrate according to some embodiments of the present disclosure will be described in detail below in conjunction with the accompanying drawings.

Figure 2:
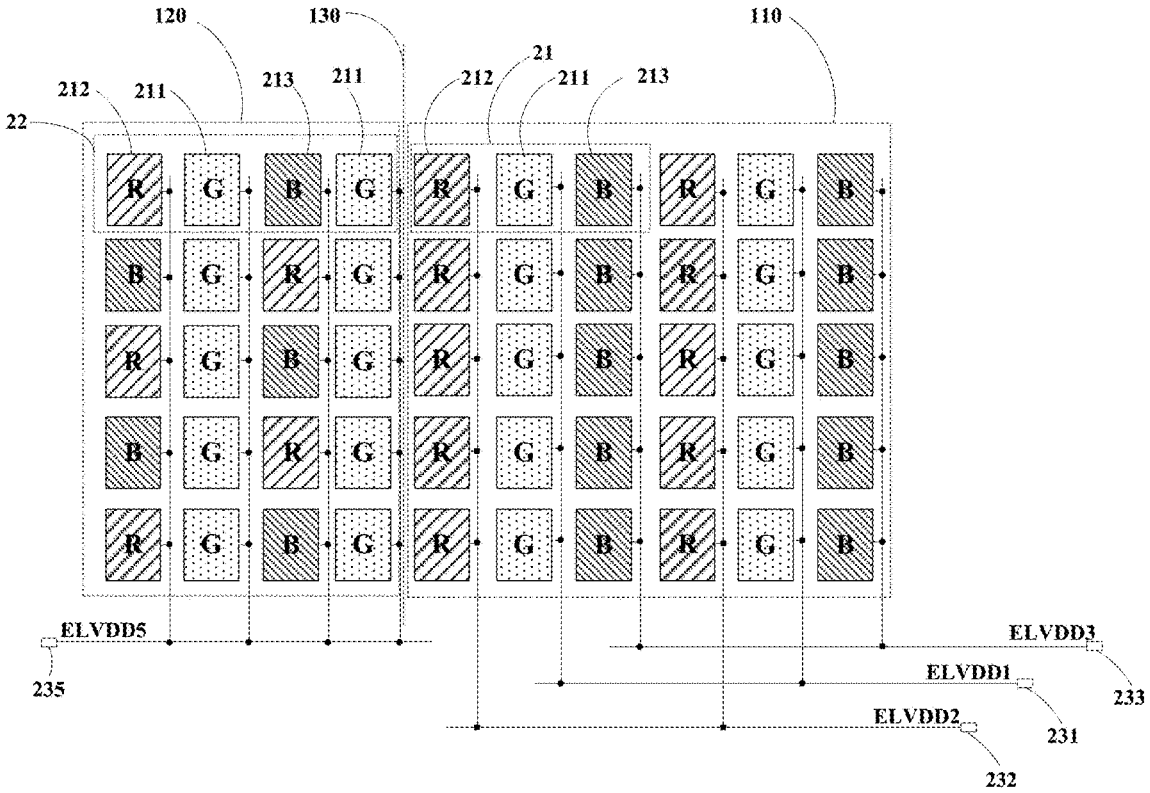
FIG. 2 is a schematic view showing a sub-pixel arrangement of a display substrate according to an embodiment of the present disclosure.

FIG. 2 is a schematic view showing a sub-pixel arrangement of a display substrate according to an embodiment of the present disclosure. FIG. 2 schematically shows a bending area 110, a flat area 120, and a bending starting position 130.

As shown in FIG. 2, the display substrate comprises the bending area 110. The bending area 110 comprises a plurality of first sub-pixels 211 and a plurality of other sub-pixels having a light emission color different from a light emission color of the plurality of first sub-pixels 211. The plurality of first sub-pixels 211 are electrically connected to a first power supply voltage terminal 231 for providing a first power supply voltage ELVDD1 (here, ELVDD is Emission Layer Voltage Drain Drain). The plurality of other sub-pixels are electrically connected to other power supply voltage terminals different from the first power supply voltage terminal 231.

In some embodiments, as shown in FIG. 2, the plurality of other sub-pixels comprises a plurality of second sub-pixels 212 and a plurality of third sub-pixels 213. The first sub-pixels 211, the second sub-pixels 212, and the third sub-pixels 213 are sub-pixels having different light emission colors. For example, the first sub-pixel 211 is a green sub-pixel G, the second sub-pixel 212 is a red sub-pixel R, and the third sub-pixel 213 is a blue sub-pixel B.

In the above-described embodiments, the plurality of first sub-pixels in the bending area are electrically connected to the first power supply voltage terminal, and the other sub-pixels are electrically connected to the other power supply voltage terminals, so that it is possible to adjust the magnitude of the power supply voltage applied to the first sub-pixels. For example, the first power supply voltage applied to the green sub-pixel (i.e., the first sub-pixel) may be reduced, thereby alleviating the problem of a bright line at the edge of the display screen. In addition, the power supply voltage applied to the sub-pixels having other colors (e.g., red or blue) is adjusted so that it is also possible to alleviate the problem of the bright line at the edge of the display screen to a certain extent.

In some embodiments, the first power supply voltage ELVDD1 is lower than power supply voltages provided by the other power supply voltage terminals. This may alleviate the problem of the bright line at the edge of the display screen to a certain extent.

In some embodiments, as shown in FIG. 2, the other power supply voltage terminals comprise a second power supply voltage terminal 232 for providing a second power supply voltage ELVDD2 and a third power supply voltage terminal 233 for providing a third power supply voltage ELVDD3. In the bending area 110, the plurality of second sub-pixels 212 are electrically connected to the second power supply voltage terminal 232, and the plurality of third sub-pixels 213 are electrically connected to the third power supply voltage terminal 233. For example, the first power supply voltage ELVDD1 is lower than the second power supply voltage ELVDD2, or the first power supply voltage ELVDD1 is lower than the third power supply voltage ELVDD3.

In this embodiment, the first power supply voltage is lower than the second power supply voltage, or the first power supply voltage is lower than the third power supply voltage. In this way, a luminous brightness of the green sub-pixel G (i.e., the first sub-pixel) may be made lower than that of a conventional set value of the green sub-pixel. This may reduce the brightness ratio of the green sub-pixel, thereby alleviating the problem of the bright line at the edge of the display screen.

In some embodiments, the power supply voltages applied to the sub-pixels of respective colors in the bending area may be adjusted respectively (described in detail later). In this way, in addition to alleviating the problem of the bright line at the edge, display image information (information such as brightness and color coordinates) may be made to conform to a relevant range of standard image information (e.g., a predetermined brightness range, a predetermined abscissa range and a predetermined ordinate range of the color coordinates or the like) as much as possible, thereby improving the display effect.

In some embodiments, as shown in FIG. 2, in the bending area 110, sub-pixels in a same sub-pixel column are sub-pixels having a same light emission color. For example, in the bending area 110, the sub-pixels in the same sub-pixel column may be all red sub-pixels R, or all green sub-pixels G, or all blue sub-pixels B. This is beneficial to make the sub-pixels having the same light emission color be electrically connected to the corresponding same power supply voltage terminal. For example, all the green sub-pixels (i.e., the first sub-pixels) are electrically connected to the first power supply voltage terminal 231, all the red sub-pixels (i.e., the second sub-pixels) are electrically connected to the second power supply voltage terminal 232, and all the blue sub-pixels (i.e., the third sub-pixels) are electrically connected to the third power supply voltage terminal 233. In this way, it is convenient to adjust the power supply voltage applied to the sub-pixels having different colors, thereby reducing the problem of the bright line at the edge of the display screen and improving the display effect of the display screen.

In some embodiments, as shown in FIG. 2, in the bending area 110, the sub-pixels respectively in two adjacent sub-pixel columns have different light emission colors. For example, in the bending area 110, a sub-pixel column is a green sub-pixel column, and a sub-pixel column adjacent to the green sub-pixel column may be a red sub-pixel column, or a blue sub-pixel column. For example, the red sub-pixel column is an adjacent sub-pixel column on the left side of the green sub-pixel column, and the blue sub-pixel column is an adjacent sub-pixel column on the right side of the green sub-pixel. This can prevent two sub-pixel columns having the same light emission color from being adjacent, thereby improving the display effect of the display screen.

In some embodiments, as shown in FIG. 2, the bending area 110 may comprise a plurality of first-type pixels 21. Each of the plurality of first-type pixels 21 may comprise a first sub-pixel 211 (e.g., the green sub-pixel G), a second sub-pixel 212 (e.g., the red sub-pixel R), and a third sub-pixel 213 (e.g., the blue sub-pixel B) in a same sub-pixel row. In each of the plurality of first-type pixels 21, the second sub-pixel 212 and the third sub-pixel 213 are adjacent to the first sub-pixel 211 respectively, and the first sub-pixel 211 is between the second sub-pixel 212 and the third sub-pixel 213.

In some embodiments, as shown in FIG. 2, the display panel further comprises a flat area 120 adjacent to the bending area 110. The flat area 120 may comprise a plurality of second-type pixels 22. Each the plurality of second-type pixels 22 may comprise two first sub-pixels 211 (e.g., the green sub-pixels G), a second sub-pixel 212 (e.g., the red sub-pixel R), and a third sub-pixel 213 (e.g. the blue sub-pixel B) in a same sub-pixel row. In the second-type pixel 22, the second sub-pixel 212 and the third sub-pixel 213 are spaced apart by one of the two first sub-pixels 212. The two first sub-pixels 211 are spaced apart by the second sub-pixel 212 or the third sub-pixel 213. In this embodiment, in the flat area, the sub-pixels of each pixel are arranged in an RGBG (or BGRG) manner, which may improve the display effect of the display screen.

In some embodiments, as shown in FIG. 2, all first sub-pixels 211, second sub-pixels 212, and third sub-pixels 213 in the flat area 120 are electrically connected to a fifth power supply voltage terminal for providing a fifth power supply voltage ELVDD5. In this embodiment, all the sub-pixels in the flat area are electrically connected to the same power supply voltage terminal, which may simplify the complexity of the circuit in the flat area.

In the above embodiment, the arrangement of the sub-pixels in the bending area is different from the arrangement of the sub-pixels in the flat area. For example, the bending area uses the RGB sub-pixel arrangement manner, while the flat area uses the RGBG sub-pixel arrangement manner.

In other embodiments, the arrangement of the sub-pixels in the bending area is the same as the arrangement of the sub-pixels in the flat area. For example, the bending area may also use a RGBG sub-pixel arrangement manner, that is, the bending area may use the same or similar sub-pixel arrangement as the flat area in FIG. 2, and all green sub-pixels (i.e., the first sub-pixels) in the bending area are electrically connected to the first power supply voltage terminal, all red sub-pixels (i.e., the second sub-pixels) in the bending area are electrically connected to the second power supply voltage terminal, and all blue sub-pixels (i.e., the third sub-pixels) in the bending area are electrically connected to the third power supply voltage terminal. For another example, the bending area may also use a RGB sub-pixel arrangement manner, that is, the flat area may use the same or similar sub-pixel arrangement as the bending area in FIG. 2.

FIG. 3 is a schematic view showing a sub-pixel arrangement of a display substrate according to another embodiment of the present disclosure. For example, as shown in FIG. 3, the above-described other power supply voltage terminals may comprise a fourth power supply voltage terminal for providing a fourth power supply voltage ELVDD4. Compared with the display substrate shown in FIG. 2, the display substrate shown in FIG. 3 is different in that: in the bending area 110, a plurality of second sub-pixels 212 (e.g., red sub-pixels R) and a plurality of third sub-pixels 213 (e.g., blue sub-pixels B) are electrically connected to the fourth power supply voltage terminal 234, that is, electrically connected to the same power supply voltage terminal. For example, the first power supply voltage ELVDD1 is lower than the fourth power supply voltage ELVDD4. In this embodiment, the power supply voltage applied to the green sub-pixel is made to be lower than that applied to the red sub-pixel and the blue sub-pixel, which may alleviate the problem of the bright line at the edge of the display screen. In addition, this embodiment may reduce the number of circuits.

In some embodiments of the present disclosure, a display device may also be provided. The display device may comprise the display substrate (e.g., the display substrate shown in FIG. 2 or 3) as described above. For example, the display device may be any product or component having a display function, such as a display panel, a display screen, a display, a mobile phone, a tablet computer, a notebook computer, a television, or a navigator.

In some embodiments of the present disclosure, a control method for a display panel may also be provided. The display panel may comprise the display substrate as described above. The control method may comprise: providing the first power supply voltage to the plurality of first sub-pixels in the bending area, and providing other power supply voltages to the plurality of other sub-pixels in the bending area which have a light emission color different from a light emission color of the plurality of first sub-pixels. For example, the first power supply voltage is lower than the other power supply voltages. This method may reduce the problem of a bright line at the edge of the display panel.

In some embodiments, the plurality of other sub-pixels may comprise a plurality of second sub-pixels and a plurality of third sub-pixels. The first sub-pixel, the second sub-pixel, and the third sub-pixel are sub-pixels having different light emission colors. For example, the first sub-pixel is a green sub-pixel, the second sub-pixel is a red sub-pixel, and the third sub-pixel is a blue sub-pixel.

In some embodiments, the providing other power supply voltages may comprise: providing a second power supply voltage to the plurality of second sub-pixels in the bending area, and providing a third power supply voltage to the plurality of third sub-pixels in the bending area.

For example, the display panel may comprise the display substrate as shown in FIG. 2. In the control method of this embodiment, the first power supply voltage is provided to the plurality of first sub-pixels (e.g., green sub-pixels) in the bending area, the second power supply voltage is provided to the plurality of second sub-pixels (e.g., red sub-pixels) in the bending area, and the third power supply voltage is provided to the plurality of third sub-pixels (e.g., blue sub-pixels) in the bending area. For example, the first power supply voltage is lower than the second power supply voltage, or the first power supply voltage is lower than the third power supply voltage. In this embodiment, the power supply voltage applied to the green sub-pixels is made to be lower than that applied to the red sub-pixels or the blue sub-pixels, so that the problem of the bright line at the edge of the display panel may be reduced.

In other embodiments, the providing other power supply voltages may comprise: providing a fourth power supply voltage to the plurality of second sub-pixels and the plurality of third sub-pixels in the bending area.

For example, the display panel may comprise the display substrate as shown in FIG. 3. In the control method of this embodiment, the first power supply voltage is provided to the plurality of first sub-pixels (e.g., green sub-pixels) in the bending area, and the fourth power supply voltage is provided to the plurality of second sub-pixels (e.g., red sub-pixels) and the plurality of third sub-pixels (e.g., blue sub-pixels) in the bending area. For example, the first power supply voltage is lower than the fourth power supply voltage. In this embodiment, the power supply voltage applied to the green sub-pixels is made to be lower than that applied to the red sub-pixels and the blue sub-pixels, the problem of the bright line at the edge of the display panel may be reduced.

In some embodiments, by way of the control method of the above-described embodiments, the luminous brightness of the green sub-pixel G (i.e., the first sub-pixel) may be made to be lower than that of the conventional set value of the green sub-pixel, which may reduce the brightness ratio of the green sub-pixel, thereby alleviating the problem of the bright line at the edge of the display panel.

In some embodiments, in the case of alleviating the problem of the bright line at the edge, some control methods for the display panel may also be used to make display image information conform to the relevant range of standard image information as much as possible to improve the display effect as much as possible. For example, the above-described control method may further comprise steps as shown in FIG. 4.

A control method for a display panel according to some embodiments of the present disclosure will be described in detail below in conjunction with FIG. 4 or 5.

FIG. 4 is a flowchart showing a control method for a display panel according to an embodiment of the present disclosure. For example, the display panel may comprise the display substrate as shown in FIG. 2. As shown in FIG. 4, the control method comprises steps S402 to S404.

At step S402, the display image information of the bending area of the display panel and the standard image information corresponding to the display image information are obtained. The display image information comprises an abscissa and an ordinate of color coordinates, and the standard image information comprises a predetermined abscissa range and a predetermined ordinate range of the color coordinates. For example, the color coordinates may be white point color coordinates. Here, the white point color coordinates refers to the color coordinates values of a white image obtained by mixing three red, green, and blue sub-pixels.

In some embodiments, an optical measuring device may be used to capture a displayed image to collect optical data reflecting the display image information, so as to obtain the display image information of the bending area. In addition, given standard image information (or referred to as an original image information) corresponding to the display image information may also be obtained.

At step S404, at least one of the first power supply voltage, the second power supply voltage, or the third power supply voltage is adjusted according to the abscissa and the ordinate of the color coordinates of the display image information, as well as the predetermined abscissa range and the predetermined ordinate range, so that the abscissa of the color coordinates of the display image information is within the predetermined abscissa range, and the ordinate of the color coordinates of the display image information is within the predetermined ordinate range.

In some embodiments, the display image information of the bending area may be compared with the standard image information. For example, the abscissa of the color coordinates of the display image information of the bending area is compared with a predetermined abscissa range, and the ordinate of the color coordinates of the display image information of the bending area is compared with the predetermined ordinate range. In this way, the difference between the display image information and the standard image information may be obtained, thereby adjusting at least one of the first power supply voltage, the second power supply voltage, or the third power supply voltage according to the difference, so that the abscissa of the color coordinates of the display image information is within the predetermined abscissa range and the ordinate of the color coordinates of the display image information is within the predetermined ordinate range.

For example, it is possible to obtain an average value of an upper limit value and a lower limit value of the predetermined abscissa range and use the average value as a middle value of the abscissa; and then calculate a difference between the abscissa of the color coordinates of the display image information and the middle value of the abscissa. Based on the difference, it may be generally seen whether the abscissa of the color coordinates is larger or smaller. In addition, the abscissa of the color coordinates may be compared with the upper limit value and the lower limit value of the predetermined abscissa range to determine whether the abscissa of the color coordinates is within the predetermined abscissa range. In other embodiments, the difference between the abscissa of the color coordinates and the middle value of the abscissa may not be calculated as well.

For another example, it is possible to obtain an average value of an upper limit value and a lower limit value of the predetermined ordinate range and use the average value as the middle value of the ordinate; and then calculate a difference between the ordinate of the color coordinates of the display image information and the middle value of the ordinate. Based on the difference, it may be generally seen whether the ordinate of the color coordinates is larger or smaller. In addition, the ordinate of the color coordinates may be compared with the upper limit value and the lower limit value of the predetermined ordinate range to determine whether the ordinate of the color coordinates is within the predetermined ordinate range. In other embodiments, the difference between the ordinate of the color coordinates and the middle value of the ordinate may not be calculated as well.

In some embodiments, the adjusting of at least one of the first power supply voltage, the second power supply voltage, or the third power supply voltage may comprise: adjusting the second power supply voltage according to the abscissa of the color coordinates of the display image information and the predetermined abscissa range, so that the abscissa of the color coordinates of the display image information is within the predetermined abscissa range. The inventors of the present disclosure have found that, the abscissa of the color coordinates is mainly affected by the red sub-pixel (i.e., the second sub-pixel), so the abscissa of the color coordinates may be adjusted by adjusting the second power supply voltage applied to the red sub-pixel, so that the abscissa of the color coordinates of the display image information is within the predetermined abscissa range.

For example, the above-described step of adjusting the second power supply voltage may comprise: reducing the second power supply voltage in a case where the abscissa of the color coordinates of the display image information is greater than the upper limit value of the predetermined abscissa range; and increasing the second power supply voltage in a case where the abscissa of the color coordinates of the display image information is less than the lower limit value of the predetermined abscissa range. In this embodiment, the brightness of the red sub-pixel is reduced by reducing the second power supply voltage, or the brightness of the red sub-pixel is increased by increasing the second power supply voltage, thereby adjusting the abscissa of the color coordinates of the display image information.

In some embodiments, the adjusting of at least one of the first power supply voltage, the second power supply voltage, or the third power supply voltage may further comprise: adjusting at least one of the first power supply voltage or the third power supply voltage according to the ordinate of the color coordinates of the display image information and the predetermined ordinate range, so that the ordinate of the color coordinates of the display image information is within the predetermined ordinate range. The inventors of the present disclosure have found that, the ordinate of the color coordinates is mainly affected by the green sub-pixel (i.e., the first sub-pixel) and the blue sub-pixel (i.e., the third sub-pixel), so the ordinate of the color coordinates is adjusted by adjusting at least one of the first power supply voltage applied to the green sub-pixel or the third power supply voltage applied to the blue sub-pixel, so that the ordinate of the color coordinates of the display image information is within the predetermined ordinate range.

For example, the adjusting of at least one of the first power supply voltage or the third power supply voltage may comprise: reducing at least one of the first power supply voltage or the third power supply voltage in a case where the ordinate of the color coordinates of the display image information is greater than the upper limit value of the predetermined ordinate range; and increasing at least one of the first power supply voltage or the third power supply voltage in a case where the ordinate of the color coordinates of the display image information is less than the lower limit value of the predetermined ordinate range. In this embodiment, the brightness of at least one of the green sub-pixel or the blue sub-pixel is reduced by reducing at least one of the first power supply voltage or the third power supply voltage, and the brightness of at least one of the green sub-pixel or the blue sub-pixel is increased by increasing at least one of the first power supply voltage or the third power supply voltage, thereby adjusting the ordinate of the color coordinates of the display image information.

So far, a control method for a display panel according to some embodiments of the present disclosure is provided. In the control method, the display image information of the display panel and the standard image information corresponding to the display image information are obtained. The display image information comprises an abscissa and an ordinate of the color coordinates. The standard image information comprises a predetermined abscissa range and a predetermined ordinate range of the color coordinates. At least one of the first power supply voltage, the second power supply voltage, or the third power supply voltage is adjusted according to the abscissa and the ordinate of the color coordinates of the display image information, as well as the predetermined abscissa range and the predetermined ordinate range, so that the abscissa of the color coordinates of the display image information is within the predetermined abscissa range, and the ordinate of the color coordinates of the display image information is within the predetermined ordinate range. This may make the display image information conform to the relevant predetermined range of the standard image information. This does not affect the display of the image in the case where the brightness (or brightness ratio) of the green sub-pixel is reduced. Therefore, the control method for the above-described display panel may not only alleviate the problem of the bright line at the edge of the display panel, but also avoid affecting the normal display of the image, thereby improving the display effect of the display panel.

In some embodiments, the display image information may further comprise display brightness, and the standard image information may further comprise a predetermined brightness range.

For example, it is possible to obtain an average value of an upper limit value and a lower limit value of the predetermined brightness range and use the average value as the middle value of the brightness; and then calculate a difference between the display brightness of the display image information and the middle value of the brightness. Based on the difference, it may be generally seen whether the display brightness is larger or smaller. In addition, the brightness may be compared with the upper limit value and the lower limit value of the predetermined brightness range to determine whether the display brightness is within the predetermined brightness range. In other embodiments, the difference between the display brightness and the middle value of the brightness may not be calculated as well.

In some embodiments, before adjusting the second power supply voltage according to the abscissa of the color coordinates of the display image information and the predetermined abscissa range, the control method may further comprise: adjusting at least one of the first power supply voltage, the second power supply voltage, or the third power supply voltage according to the display brightness and the predetermined brightness range, so that the display brightness is within the predetermined brightness range. In this way, it is possible to make the brightness of the display image information conform to the predetermined brightness range, thereby improving the display effect of the display panel.

In some embodiments, the adjusting at least one of the first power supply voltage, the second power supply voltage, or the third power supply voltage according to the display brightness and the predetermined brightness range may comprise: reducing the first power supply voltage in a case where the display brightness is greater than the upper limit value of the predetermined brightness range; and increasing at least one of the second power supply voltage or the third power supply voltage in a case where the display brightness is less than the lower limit value of the predetermined brightness range. In this embodiment, the first power supply voltage applied to the green sub-pixel is reduced in the case where the display brightness needs to be reduced, and at least one of the second power supply voltage applied to the red sub-pixel or the third power supply voltage applied to the blue sub-pixel is increased in the case where the display brightness needs to be increased. In this way, the light emission brightness of the green sub-pixel in the bending area may be reduced as much as possible, thereby alleviating the problem of the bright line at the edge of the display panel.

For example, the predetermined brightness range under a 255 grayscale image is 450 nit±3%, that is [436.5, 463.5], and the actual brightness of the edge area in the current screen is acquired to be 470 nit. The actual brightness is greater than the upper limit value of 463.5 nit. In order to alleviate the problem of the bright line at the edge and reduce the display brightness to the predetermined brightness range, it may be achieved by reducing the first power supply voltage applied to the green sub-pixel. For another example, if the actual brightness of the edge area in the current screen is 430 nit, which is less than the lower limit value of 436.5 nit, the display brightness may be increased by increasing at least one of the second power supply voltage applied to the red sub-pixel or the third power supply voltage applied to the blue sub-pixel.

In some embodiments, the control method may further comprise: determining whether an adjusted display brightness is within the predetermined brightness range, whether an adjusted abscissa of the color coordinates is within the predetermined abscissa range, and whether an adjusted ordinate of the color coordinates is within the predetermined ordinate range. At least one of the first power supply voltage, the second power supply voltage, or the third power supply voltage is continuously adjusted so that the display brightness of the display image information is adjusted to be within the predetermined brightness range in a case where the adjusted display brightness is not within the predetermined brightness range. The second power supply voltage is continuously adjusted so that the abscissa of the color coordinates of the display image information is adjusted to be within the predetermined abscissa range in a case where the adjusted abscissa of the color coordinates is not within the predetermined abscissa range. At least one of the first power supply voltage or the third power supply voltage is continuously adjusted so that the ordinate of the color coordinates of the display image information is adjusted to be within the predetermined ordinate range in a case where the adjusted ordinate of the color coordinates is not within the predetermined ordinate range. By these adjustments, the display image information may be made to conform to the standard image information as much as possible, so as to avoid affecting the display effect of the image as much as possible in the case of reducing the brightness (or brightness ratio) of the green sub-pixel.

Figure 5:
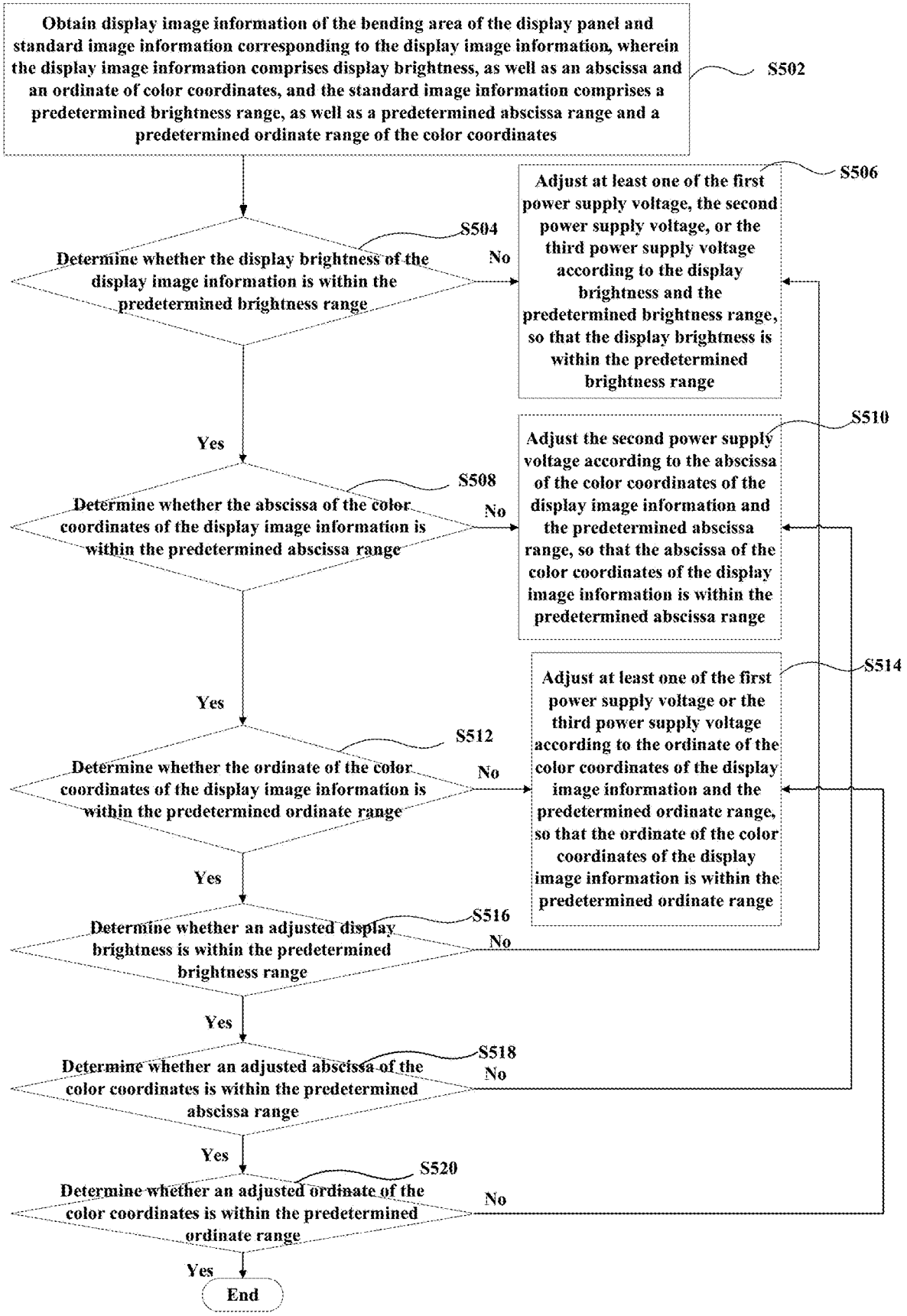
FIG. 5 is a flowchart showing a control method for a display panel according to another embodiment of the present disclosure.

FIG. 5 is a flowchart showing a control method for a display panel according to another embodiment of the present disclosure. For example, the display panel may comprise the display substrate as shown in FIG. 2. As shown in FIG. 5, the control method may comprise steps S502 to S520.

At step S502, display image information of the bending area of the display panel and standard image information corresponding to the display image information are obtained. The display image information comprises display brightness, as well as an abscissa and an ordinate of color coordinates. The standard image information comprises a predetermined brightness range, as well as a predetermined abscissa range and a predetermined ordinate range of the color coordinates.

At step S504, it is determined whether the display brightness of the display image information is within the predetermined brightness range. If yes, the process proceeds to step S508; otherwise, the process proceeds to step S506.

At step S506, at least one of the first power supply voltage, the second power supply voltage, or the third power supply voltage is adjusted according to the display brightness and the predetermined brightness range, so that the display brightness is within the predetermined brightness range.

For example, the first power supply voltage is reduced in the case where the display brightness is greater than the upper limit value of the predetermined brightness range; at least one of the second power supply voltage or the third power supply voltage is increased in the case where the display brightness is less than the lower limit value of the predetermined brightness range.

At step S508, it is determined whether the abscissa of the color coordinates of the display image information is within the predetermined abscissa range. If yes, the process proceeds to step S512; otherwise, the process proceeds to step S510.

At step S510, the second power supply voltage is adjusted according to the abscissa of the color coordinates of the display image information and the predetermined abscissa range, so that the abscissa of the color coordinates of the display image information is within the predetermined abscissa range.

For example, the second power supply voltage is reduced in the case where the abscissa of the color coordinates of the display image information is greater than the upper limit value of the predetermined abscissa range; the second power supply voltage is increased in the case where the abscissa of the color coordinates of the display image information is less than the lower limit value of the predetermined abscissa range.

At step S512, it is determined whether the ordinate of the color coordinates of the display image information is within the predetermined ordinate range. If yes, the process proceeds to step S516; otherwise, the process proceeds to step S514.

At step S514, at least one of the first power supply voltage or the third power supply voltage is adjusted according to the ordinate of the color coordinates of the display image information and the predetermined ordinate range, so that the ordinate of the color coordinates of the display image information is within the predetermined ordinate range.

For example, at least one of the first power supply voltage or the third power supply voltage is reduced in the case where the ordinate of the color coordinates of the display image information is greater than the upper limit value of the predetermined ordinate range; at least one of the first power supply voltage or the third power supply voltage is increased in the case where the ordinate of the color coordinates of the display image information is less than the lower limit value of the predetermined ordinate range.

During the above-described adjustment process, the display brightness and the color coordinates of the display image information may possibly change. For example, in order to adjust the ordinate of the color coordinates, it is necessary to adjust at least one of the first power supply voltage or the third power supply voltage, which might result in that the adjusted display brightness is not within the predetermined brightness range. Therefore, it is possible to continue to determine whether the display brightness and the color coordinates are within the respective predetermined ranges.

At step S516, it is determined whether an adjusted display brightness is within the predetermined brightness range. If yes, the process proceeds to step S518; otherwise, the process returns to step S506, that is, at least one of the first power supply voltage, the second power supply voltage, or the third power supply voltage is continuously adjusted so that the display brightness of the display image information is adjusted to be within the predetermined brightness range.

At step S518, it is determined whether an adjusted abscissa of the color coordinates is within the predetermined abscissa range. If yes, the process proceeds to step S520; otherwise, the process returns to step S510, that is, the second power supply voltage is continuously adjusted so that the abscissa of the color coordinates of the display image information is adjusted to be within the predetermined abscissa range.

At step S520, it is determined whether an adjusted ordinate of the color coordinates is within the predetermined ordinate range. If yes, the process ends; otherwise, the process returns to step S514, that is, at least one of the first power supply voltage or the third power supply voltage is continuously adjusted so that the ordinate of the color coordinates of the display image information is adjusted to be within the predetermined ordinate range.

In some embodiments, steps S516 to S520 may be repeatedly performed until the display brightness and the color coordinates are within the respective corresponding predetermined ranges.

So far, a control method for a display panel according to some embodiments of the present disclosure is provided. By way of the control method, the display image information may be made to conform to the relevant predetermined range of the standard image information. This may avoid affecting the display of the image in the case of reducing the brightness (or brightness ratio) of the green sub-pixel. Therefore, the control method for the above-described display panel may not only reduce the problem of the bright line at the edge of the display panel, but also may avoid affecting the normal display of the image, thereby improving the display effect of the display panel.

In some embodiments, it is possible to increase the brightness of the red sub-pixel or the blue sub-pixel of the bending area, and reduce the brightness of the green sub-pixel, thereby alleviating the problem of the yellowing of the edge. In addition, by using the above-described control method, it is possible to further alleviating the problem of the yellowing of the edge of the display panel, and improve the screen quality under a positive viewing angle.

Figure 6:
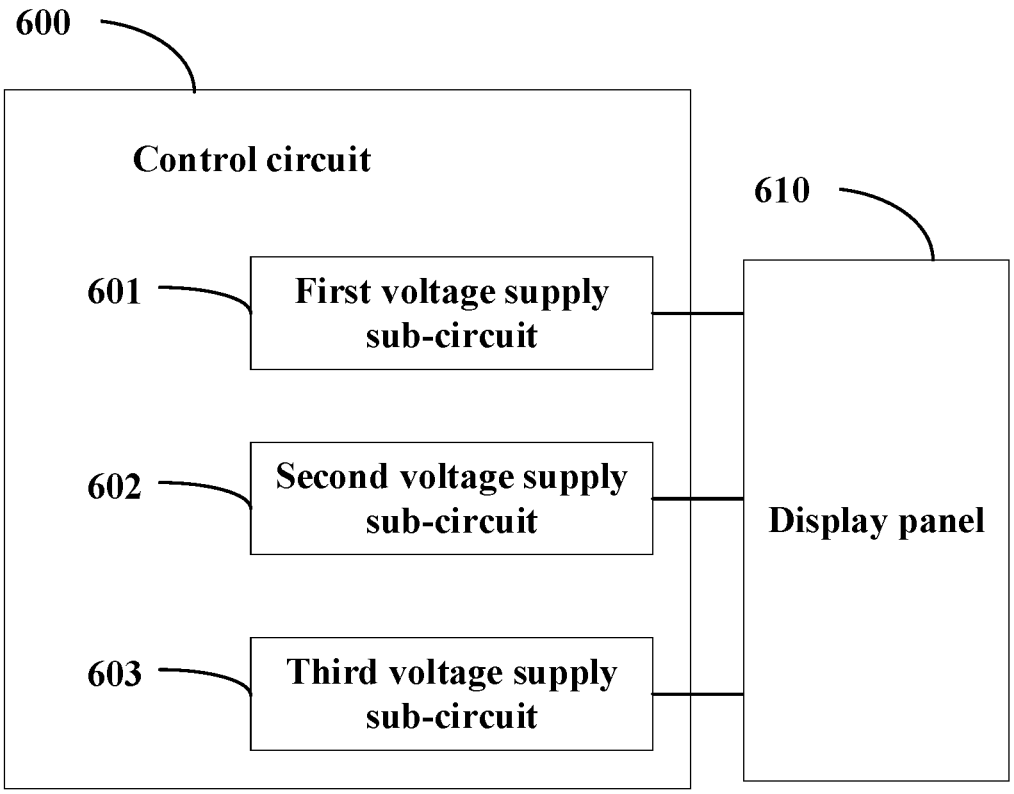
FIG. 6 is a structural block view showing a control circuit for a display panel according to an embodiment of the present disclosure.

FIG. 6 is a structural block view showing a control circuit for a display panel according to an embodiment of the present disclosure. For convenience of description, a display panel 610 is shown in FIG. 6. For example, the display panel comprises the display substrate as described above.

In some embodiments, as shown in FIG. 6, the control circuit 600 comprises a first voltage supply sub-circuit 601 and other voltage supply sub-circuits.

The first voltage supply sub-circuit 601 is configured to provide a first power supply voltage to a plurality of first sub-pixels in the bending area.

The other voltage supply sub-circuits are configured to provide other power supply voltages to a plurality of other sub-pixels in the bending area which have a light emission color different from a light emission color of the first sub-pixels. For example, the plurality of other sub-pixels comprises a plurality of second sub-pixels and a plurality of third sub-pixels. The plurality of first sub-pixels, the plurality of second sub-pixels, and the plurality of third sub-pixels are sub-pixels having different light emission colors. The first power supply voltage is lower than the second power supply voltage, or the first power supply voltage is lower than the third power supply voltage.

In some embodiments, as shown in FIG. 6, the other voltage supply sub-circuits may comprise a second voltage supply sub-circuit 602 and a third voltage supply sub-circuit 603. The second voltage supply sub-circuit 602 is configured to provide a second power supply voltage to the plurality of second sub-pixels in the bending area. The third voltage supply sub-circuit 603 is configured to provide a third power supply voltage to the plurality of third sub-pixels in the bending area.

In the control circuit of the above-described embodiment, the first power supply voltage is provided by the first voltage supply sub-circuit to the plurality of first sub-pixels in the bending area, and the other power supply voltages are provided by the other voltage supply sub-circuits to the plurality of other sub-pixels in the bending area which have a light emission color different from a light emission color of the plurality of first sub-pixels. For example, the first power supply voltage is lower than the power supply voltages provided by the other power supply voltage terminals. This may alleviate the problem of the bright line at the edge of the display screen to a certain extent.

Figure 7:
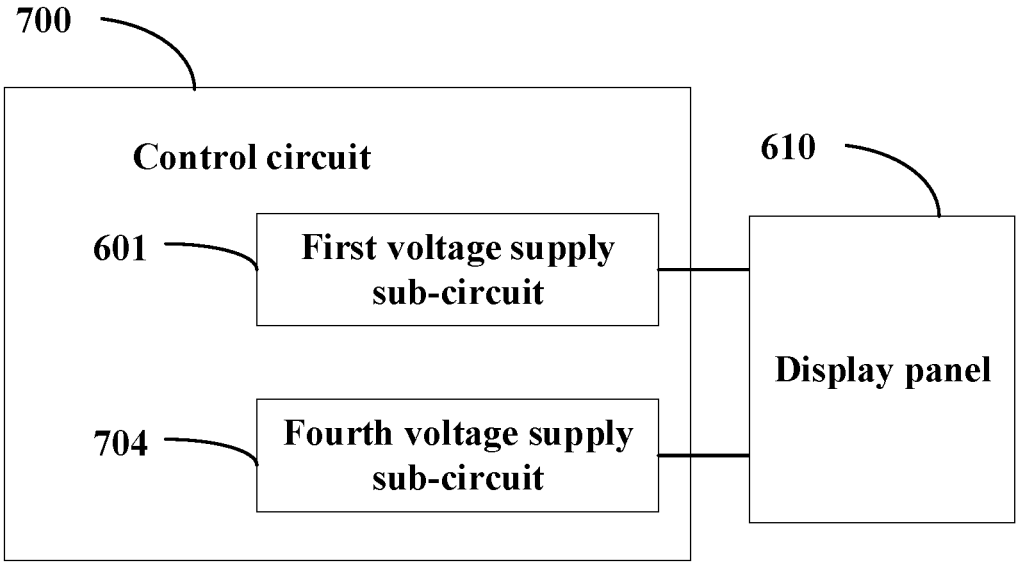
FIG. 7 is a structural block view showing a control circuit for a display panel according to another embodiment of the present disclosure.

FIG. 7 is a structural block view showing a control circuit for a display panel according to another embodiment of the present disclosure. As shown in FIG. 7, the control circuit 700 comprise the first voltage supply sub-circuit 601 and other voltage supply sub-circuits.

In some embodiments, as shown in FIG. 7, the other voltage supply sub-circuits may comprise a fourth voltage supply sub-circuit 704. The fourth voltage supply sub-circuit 704 is configured to provide a fourth power supply voltage to the plurality of second sub-pixels and the plurality of third sub-pixels in the bending area. For example, the first power supply voltage is lower than the fourth power supply voltage. This embodiment may also alleviate the problem of the bright line at the edge of the display screen to a certain extent.

Figure 8:
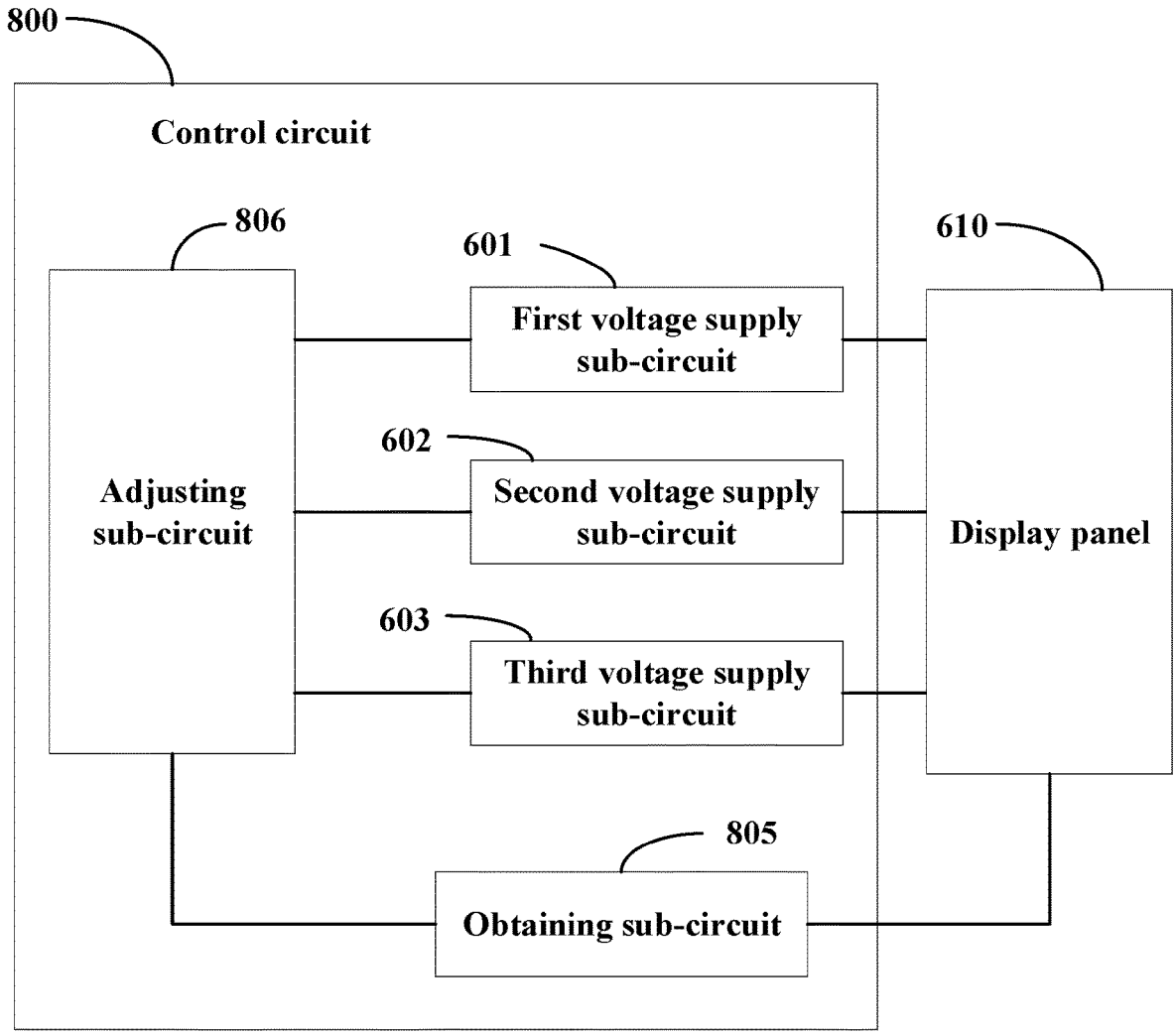
FIG. 8 is a structural block view showing a control circuit for a display panel according to another embodiment of the present disclosure.

FIG. 8 is a structural block view showing a control circuit for a display panel according to another embodiment of the present disclosure. As shown in FIG. 8, the control circuit 800 may comprise the first voltage supply sub-circuit 601, the second voltage supply sub-circuit 602, and the third voltage supply sub-circuit 603. In addition, the display panel 610 is also shown in FIG. 8.

In some embodiments, as shown in FIG. 8, the control circuit 800 may further comprise an obtaining sub-circuit 805 and an adjusting sub-circuit 806.

The obtaining sub-circuit 805 is configured to obtain display image information of the bending area of the display panel 610 and standard image information corresponding to the display image information. The display image information comprises an abscissa and an ordinate of the color coordinates. The standard image information comprises a predetermined abscissa range and a predetermined ordinate range of the color coordinates.

The adjusting sub-circuit 806 is configured to adjust at least one of the first power supply voltage, the second power supply voltage, or the third power supply voltage according to the abscissa and the ordinate of the color coordinates of the display image information, as well as the predetermined abscissa and the predetermined ordinate, so that the abscissa of the color coordinates of the display image information is within the predetermined abscissa range, and the ordinate of the color coordinates of the display image information is within the predetermined ordinate range.

The above-described control circuit may make the abscissa of the color coordinates of the display image information within the predetermined abscissa range, and the ordinate of the color coordinates of the display image information within the predetermined ordinate range. This may alleviate the problem of the bright line at the edge of the display panel, and may not affect the normal display of the image, as well thereby improving the display effect of the display panel.

In some embodiments, the adjusting sub-circuit 806 may be configured to adjust the second power supply voltage according to the abscissa of the color coordinates of the display image information and the predetermined abscissa range, so that the abscissa of the color coordinates of the display image information is within the predetermined abscissa range. The adjusting sub-circuit 806 may be further configured to adjust at least one of the first power supply voltage or the third power supply voltage according to the ordinate of the color coordinates of the display image information and the predetermined ordinate range, so that the ordinate of the color coordinates of the display image information is within the predetermined ordinate range.

In some embodiments, the display image information may further comprise display brightness, and the standard image information may further comprise a predetermined brightness range. The adjusting sub-circuit 806 may be further configured to adjust at least one of the first power supply voltage, the second power supply voltage, or the third power supply voltage according to the display brightness and the predetermined brightness range, so that the display brightness is within the predetermined brightness range.

In some embodiments, the adjusting sub-circuit 806 may be further configured to determine whether an adjusted display brightness is within the predetermined brightness range, whether an adjusted abscissa of the color coordinates is within the predetermined abscissa range, and whether an adjusted ordinate of the color coordinates is within the predetermined ordinate range. The adjusting sub-circuit 806 may be further configured to continue to adjust at least one of the first power supply voltage, the second power supply voltage, or the third power supply voltage so that the display brightness of the display image information is adjusted to be within the predetermined brightness range, in the case where the adjusted display brightness is not within the predetermined brightness range. The adjusting sub-circuit 806 may be further configured to continue to adjust the second power supply voltage so that the abscissa of the color coordinates of the display image information is adjusted to be within the predetermined abscissa range, in the case where the adjusted abscissa of the color coordinates is not within the predetermined abscissa range. The adjusting sub-circuit 806 may be further configured to continue to adjust at least one of the first power supply voltage or the third power supply voltage so that the ordinate of the color coordinates of the display image information is adjusted to be within the predetermined ordinate range, in the case where the adjusted ordinate of the color coordinates is not within the predetermined ordinate range.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments or equivalently substitution of part of the technical features may be made without departing from the scope and spirit of the present disclosure. The scope of the present disclosure is defined by the appended claims.

What is claimed is:

1. A control method for a display panel, comprising:

providing a first power supply voltage to a plurality of first sub-pixels in a bending area of a display substrate of the display panel;

providing a second power supply voltage to a plurality of second sub-pixels in the bending area;

providing a third power supply voltage to a plurality of third sub-pixels in the bending area, wherein each of the plurality of first sub-pixels is a green sub-pixel, each of the plurality of second sub-pixels is a red sub-pixel, and each of the plurality of third sub-pixels is a blue sub-pixel;

obtaining display image information of the bending area of the display panel and standard image information corresponding to the display image information, wherein the display image information comprises an abscissa and an ordinate of color coordinates and a display brightness, and the standard image information comprises a predetermined abscissa range and a predetermined ordinate range of the color coordinates and a predetermined brightness range;

adjusting at least one of the first power supply voltage, the second power supply voltage, or the third power supply voltage according to the display brightness and the predetermined brightness range so that the display brightness is within the predetermined brightness range;

adjusting the second power supply voltage according to the abscissa of the color coordinates of the display image information and the predetermined abscissa range, so that the abscissa of the color coordinates of the display image information is within the predetermined abscissa range;

adjusting at least one of the first power supply voltage or the third power supply voltage according to the ordinate of the color coordinates of the display image information and the predetermined ordinate range, so that the ordinate of the color coordinates of the display image information is within the predetermined ordinate range; and determining whether an adjusted display brightness is within the predetermined brightness range, whether an adjusted abscissa of the color coordinates is within the predetermined abscissa range, and whether an adjusted ordinate of the color coordinates is within the predetermined ordinate range, wherein at least one of the first power supply voltage, the second power supply voltage, or the third power supply voltage is continuously adjusted so that the display brightness of the display image information is adjusted to be within the predetermined brightness range in a case where the adjusted display brightness is not within the predetermined brightness range, wherein the second power supply voltage is continuously adjusted so that the abscissa of the color coordinates of the display image information is adjusted to be within the predetermined abscissa range in a case where the adjusted abscissa of the color coordinates is not within the predetermined abscissa range; and at least one of the first power supply voltage or the third power supply voltage is continuously adjusted so that the ordinate of the color coordinates of the display image information is adjusted to be within the predetermined ordinate range in a case where the adjusted ordinate of the color coordinates is not within the predetermined ordinate range.

2. The control method according to claim 1, wherein the abscissa of the color coordinates of the display image information is greater than an upper limit value of the predetermined abscissa range, and the adjusting of the second power supply voltage according to the abscissa of the color coordinates of the display image information and the predetermined abscissa range comprises: reducing the second power supply voltage.

3. The control method according to claim 1, wherein the display brightness is greater than an upper limit value of the predetermined brightness range, and the adjusting of at least one of the first power supply voltage, the second power supply voltage or the third power supply voltage according to the display brightness and the predetermined brightness range comprises: reducing the first power supply voltage.

4. The control method according to claim 1, wherein the abscissa of the color coordinates of the display image information is less than a lower limit value of the predetermined abscissa range, and the adjusting of the second power supply voltage according to the abscissa of the color coordinates of the display image information and the predetermined abscissa range comprises: increasing the second power supply voltage.

5. The control method according to claim 1, wherein the ordinate of the color coordinates of the display image information is greater than an upper limit value of the predetermined ordinate range, and the adjusting of at least one of the first power supply voltage or the third power supply voltage according to the ordinate of the color coordinates of the display image information and the predetermined ordinate range comprises: reducing at least one of the first power supply voltage or the third power supply voltage.

6. The control method according to claim 1, wherein the ordinate of the color coordinates of the display image information is less than a lower limit value of the predetermined ordinate range, and the adjusting of at least one of the first power supply voltage or the third power supply voltage according to the ordinate of the color coordinates of the display image information and the predetermined ordinate range comprises: increasing at least one of the first power supply voltage or the third power supply voltage.

7. The control method according to claim 1, wherein the display brightness is less than a lower limit value of the predetermined brightness range, and the adjusting of at least one of the first power supply voltage, the second power supply voltage, or the third power supply voltage according to the display brightness and the predetermined brightness range comprises: increasing at least one of the second power supply voltage or the third power supply voltage.

* * * * *